US005296131A

United States Patent [19]

Raterman

[11] Patent Number: 5,296,131

[45] Date of Patent: Mar. 22, 1994

[54] PROCESS FOR SHORT CONTACT TIME CRACKING

[75] Inventor: Michael F. Raterman, Doylestown, Pa.

[73] Assignee: Mobil Oil Corporation, Fairfax, Va.

[21] Appl. No.: 984,630

[22] Filed: Dec. 2, 1992

[51] Int. Cl.[5] ..... C10G 11/18; C10G 35/14

[52] U.S. Cl. ..... 208/113; 208/152; 208/153; 208/157; 208/161; 208/163; 208/164

[58] Field of Search ..... 208/153, 167, 161, 153, 208/113, 160, 168, 120, 155, 156, 127, 164, 112, 152; 422/144

[56] References Cited

U.S. PATENT DOCUMENTS

| | | | |
|---|---|---|---|
| 4,435,272 | 3/1984 | Bartholic et al. | 208/127 |
| 4,800,014 | 6/1989 | Hays et al. | 208/157 |
| 4,904,281 | 2/1990 | Raterman | 55/1 |
| 4,919,898 | 4/1990 | Gartside et al. | 422/219 |
| 4,985,136 | 1/1991 | Bartholic | 208/153 |

*Primary Examiner*—Mark L. Bell
*Assistant Examiner*—Bekir L. Yildirim
*Attorney, Agent, or Firm*—Alexander J. McKillop; Malcolm D. Keen; Richard D. Stone

[57] ABSTRACT

A process for short contact time cracking of heavy feed. A falling, annular curtain of hot regenerated FCC catalyst, or hot inert solids, is formed over a cone shaped plug valve. Hydrocarbons pass from under the cone, or via a hollow stem, in radial in to out flow to contact the falling curtain of solids. After 0.01 to 1.0 seconds of contact time, solids and cracked vapor are separated, preferably in a bell separator beneath the reaction zone. Downflow of reactants into a contiguous upflowing stripper minimizes attrition.

15 Claims, 2 Drawing Sheets

PROCESS FOR SHORT CONTACT TIME CRACKING

BACKGROUND OF THE INVENTION

1. FIELD OF THE INVENTION

The invention relates to a process and apparatus for the regeneration of fluidized catalytic cracking catalyst.

2 DESCRIPTION OF RELATED ART

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking has undergone progressive development since the 40s. The trend of development of the fluid catalytic cracking (FCC) process has been to all riser cracking and use of zeolite catalysts. A good overview of the importance of the FCC process, and its continuous advancement, is reported in Fluid Catalytic Cracking Report, Amos A. Avidan, Michael Edwards and Hartley Owen, as reported in the Jan. 8, 1990 edition of the *Oil & Gas Journal.*

Modern catalytic cracking units use active zeolite catalyst to crack the heavy hydrocarbon feed to lighter, more valuable products. Instead of dense bed cracking, with a hydrocarbon residence time of 20–60 seconds, much less contact time is needed. The desired conversion of feed can now be achieved in much less time, and more selectively, in a dilute phase, riser reactor.

There has been considerable evolution in the design of FCC units, which evolution is reported to a limited extent in the Jan. 8, 1990 *Oil & Gas Journal* article. Many FCC designs have evolved.

The Kellogg Ultra Orthoflow converter, Model F, shown in FIG. 1 of this patent application, and also shown as FIG. 17 of the Jan. 8, 1990 *Oil & Gas Journal* article discussed above, is an example of a modern, efficient FCC unit. This design (and many other FCC designs not shown) converts a heavy feed into a spectrum of valuable cracked products in 2–10 seconds of residence time in a riser reactor. The units are very efficient for cracking heavy feeds but present some design challenges. One of the most challenging features is the ceramic plug valves used to control flow of solids within a vessel, where no slide valve can be located. These valves tend to stick, and large amounts of purge gas are needed to keep the interior parts of the plug valve free of catalyst.

Hollow stem plug valves, suitable for use in Orthoflow type units are, disclosed in U.S. Pat. No. 2,850,364 and U.S. Pat. No. 4,827,967, which are incorporated by reference.

Most refiners now use all riser cracking today, as compared to dense bed cracking which was the prevalent reactor design in the 40's through the 60's. Refiners know that short contact time riser cracking is beneficial and have tried to use conventional equipment to shorten residence time and minimize thermal cracking. Approaches include riser quenching and closed cyclones which reduce post-riser thermal cracking. Some refiners have dropped pressure to increase selectivity. Some have gone to short contact time cracking reactors, usually involving higher vapor velocities in the risers.

It is difficult to use conventional riser reactors and have short contact time by using high velocities because the higher velocities increase the erosive power of the FCC catalyst. High velocities are hard on the equipment, which is subjected to years of "sandblasting" and hard on the FCC catalyst, which attrits when it hits solid objects at high speed.

A limited amount of work has been done on extremely short contact time FCC reactors. Most of it involves downflow reactors and solving problems associated with intimately contacting hot regenerated catalyst with oil and then separating cracked products from spent catalyst within a second or less. Current state of the art risers have oil residence times as low as one second, while some proposed designs will operate with even less residence time in the riser.

U.S. Pat. No. 4,832,825 uses a riser of 5 to 40 meters and high velocity in the riser to achieve hydrocarbon residence times of 0.05 to 10 seconds. Material exiting the riser 1 is deflected down by a cap to effect some measure of spent catalyst and cracked product separation.

U.S. Pat. No. 4,919,898 Gartside et al, which is incorporated by reference, teaches a short residence time apparatus for cracking hydrocarbon with hot solids. An annular falling curtain of hot solids contacts opposing spray feed nozzles. Catalyst flow is controlled by changing the pressure (via steam injection) in a solids reservoir above a plug valve 14 having a spherical base portion with arcuate contours 15. There is fairly efficient formation of a large surface area annular sheet of catalyst, but the nozzle configuration shown will not ensure uniform catalyst and oil contact circumferentially around the contours 15. The nozzles are basically point devices, while the catalyst forms a plane, and perfect contact of a plane using a plurality of points is not possible. The catalyst and oil mixture passes down into a larger separation area, comprising a horizontal plate. Cracked products are withdrawn from above the plate so cracked gases follow a 180 degree path from inlet to outlet. The separator is reported to recover from 95 to 99% of the solids.

U.S. Pat. No. 4,433,984, which is incorporated by reference, teaches a short contact time cracking process, with rapid separation of solids from cracked gases leaving a cracking reactor.

U.S. Pat. No. 4,985,136, which is incorporated by reference, discloses a falling curtain FCC reactor, using very high zeolite content cracking catalyst (40 to 80% zeolite) to crack heavy feed within 0.5 seconds or less. Catalyst falls down, and oil is injected horizontally into a cyclone separator 66. A falling wall of catalyst is contacted by one or more sprays or jets of feed, so there will be some areas with high catalyst concentrations and low amounts of feed, and some areas with excessive amounts of hydrocarbon, especially if a nozzle malfunctions and develops a narrow jet or spray of feed rather than a more diffuse spray. The cyclone dipleg discharged catalyst into a large stripping section 10.

While many improvements have been made in developing an effective short contact time cracking process, none were entirely satisfactory. I was most concerned about two areas: initial contacting of catalyst (or other hot solids in the case of thermal processes) and oil, and the efficient separation of cracked products from spent catalyst (or coked solids).

The falling curtain concept is a good one but creates problems. Achieving an annular curtain or shower of catalyst provides maximum exposure of catalyst to oil, but such flows are hard to control accurately, especially so when a run length of years is contemplated. Formation of a wall or plane of falling catalyst, rather than an annulus, is simpler, but requires a thicker wall for a given amount of catalyst flux as compared to an annulus of catalyst in a vessel with the same diameter.

The rapid separation of catalyst, or solids, downstream of a short contact time reactor presents more challenges to the chemical engineer. The use of an enlarged separation section, with reactor products discharging down onto a horizontal plate in U.S. Pat. No. 4,919,898, forcing the cracked vapor to make a 180 degree turn to a vapor outlet, produces significant separation but is not optimum. Horizontal discharge into a cyclone inlet, as in U.S. Pat. No. 4,985,136, allows efficient separation but is hard on the cyclones and requires some work because of the pressure drop associated with the cyclone.

An additional problem with a resid cracking unit is higher temperature. The temperature of regenerated catalyst tends to increase as the FCC feed gets worse, and the higher temperatures associated with resid cracking (or short contact time cracking of VGO) weaken the metal used in most catalyst flow control valves.

I realized that most of the difficulties of the existing approaches to short contact time cracking, whether catalytic or thermal, could be overcome by using a plug valve to control flow of and distribute hot solids into an annular, falling curtain or sheet of catalyst, and simultaneously admit part or all of the feed through the radial opening under the plug valve seat. I realized that these conventional plug valves, which have proven highly reliable in years of service in conventional FCC units, could be used as part of a robust short contact time FCC unit or thermal cracking unit. Using the body of the valve to admit feed permitted a measure of preheating of the feed to be achieved and made a vice of these valves (their need for constant addition of purge gas) a virtuous way to add feed; which even cooled the valve. In a preferred design, I couple this new reactor design with an improved catalyst/vapor separator, providing for low impact separation which is also highly efficient.

BRIEF SUMMARY OF THE INVENTION

Accordingly, the present invention provides a process for the fluidized catalytic cracking of a heavy feed to lighter products comprising: forming a falling, annular curtain of regenerated FCC catalyst by discharging said FCC catalyst down through a vertical, cone shaped plug valve having a base attached to a vertical stem which controls the flow of said catalyst; contacting said falling annular curtain of catalyst with a heavy feed by discharging from at least one of the base of the cone shaped plug valve or the stem of said valve said hydrocarbon feed in radial in to out flow, forming a downflowing mixture of catalyst and feed and vaporizing at least a majority by weight of said feed; cracking said feed in a vertical, cylindrical reactor vessel by passing said downflowing mixture as an annulus defined by the walls of said reactor vessel and the stem of said plug valve at catalytic cracking conditions including a superficial vapor velocity of at least 20 feet per second and a total catalyst and hydrocarbon vapor contact time of 0.01 to 1.0 seconds to produce cracked vapor products and spent catalyst; separating cracked products from spent products in an inertial separation means to produce a cracked product vapor phase and a spent catalyst phase; recovering cracked products from said cracked product vapor phase as products of the process; stripping said spent catalyst phase in a catalyst stripping means at catalyst stripping conditions to produce stripped catalyst; regenerating in a catalyst regeneration means operating at catalyst regeneration conditions said spent catalyst to produce regenerated catalyst; and charging regenerated catalyst to the top of said plug valve.

In a preferred embodiment, the present invention provides a process for the fluidized catalytic cracking of a heavy feed to lighter products comprising forming a falling, annular curtain of regenerated FCC catalyst by discharging said FCC catalyst down through a vertical, cone shaped plug valve having a base attached to a vertical stem which controls the flow of said catalyst; contacting said falling annular curtain of catalyst with a heavy feed by discharging from at least one of the base of the cone shaped plug valve or the stem of said valve said hydrocarbon feed in radial in to out flow, forming a downflowing mixture of catalyst and feed and vaporizing at least a majority by weight of said feed; cracking said feed in a vertical, cylindrical reactor vessel having a vertical axis by passing said downflowing mixture as an annulus defined by the walls of said reactor vessel and the stem of said plug valve at catalytic cracking conditions including a superficial vapor velocity of 20 to 200 feet per second and a total catalyst and hydrocarbon vapor contact time of 0.01 to 1.0 seconds to produce cracked vapor products and spent catalyst; separating cracked products from spent catalyst in a vertical, cylindrical, bell shaped, inertial separation means having a vertical axis axially aligned with said vertical axis of said cracking reactor and contiguous with and beneath said cracking reactor, to produce a cracked product vapor phase and a spent catalyst phase, said inertial separator comprising: an annular inlet for catalyst and cracked products in an upper portion of said bell separator having a diameter, and defined by the wall of said valve stem and a circumferential lip; an annular flow expansion and vapor flow reversal section downstream of said annular inlet, defined by the wall of said valve stem and an outer wall of the cylindrical bell shaped separator, said outer wall having a diameter greater than the diameter of the reactor or of the diameter of the annular inlet, and having: an inlet for stripping gas in a lower portion thereof; and an outlet for stripped catalyst in a lower portion thereof; and at least one vapor outlet in an upper portion thereof connective with and passing through said outer wall of said cylindrical separator vessel and connective with an annular, circumferential vapor removal means extending 360 degrees about the wall of said separator, defined by said circumferential lip and said wall of said separator; regenerating in a catalyst regeneration means operating at catalyst regeneration conditions said spent catalyst to produce regenerated catalyst; and charging regenerated catalyst to the top of said plug valve.

In an apparatus embodiment, the present provides an apparatus for contacting fluidized solids with a heavy hydrocarbon feed to produce lighter, cracked products comprising: a vertical, cylindrical reactor vessel having a top, a bottom, and a vertical axis a regenerated solids inlet in the top thereof connective with a source of regenerated solids, said inlet comprising a vertical, cone shaped plug valve having a base and a hollow stem for forming a falling, annulus of regenerated solids about said plug valve and said hollow stem; an inlet for hydrocarbon feed through the bottom of said reactor for passing feed through said hollow stem up to said base of said plug valve, and via a plurality of radially distributed feed nozzles to contact said feed with said falling curtain of solids in radial in-to-out flow and form a falling mixture of solids and added feed; a vertical annular reaction chamber for receiving said falling mixture of solids and feed, said annular reaction chamber having an inner wall defined by said hollow stem of said plug valve and an outer wall; and an outlet in a lower portion of said reaction chamber for discharge of cracked feed and coked solids; a vertical, cylindrical solids and vapor separation means contiguous with and axially aligned with, and beneath said reaction chamber, having an inlet in an upper portion thereof for said coked solids and cracked products, an inlet in a lower portion thereof for stripping gas, an outlet in a lower portion thereof for stripped, coked solids, and an outlet in an upper portion thereof for cracked products; and a coked solids regeneration means having an inlet connective with said stripped solids outlet, an inlet for regeneration gas, an outlet for flue gas, and an outlet for regenerated solids connective with said inlet for regenerated solids of said reactor means.

DESCRIPTION OF PREFERRED EMBODIMENTS

Figure 1:
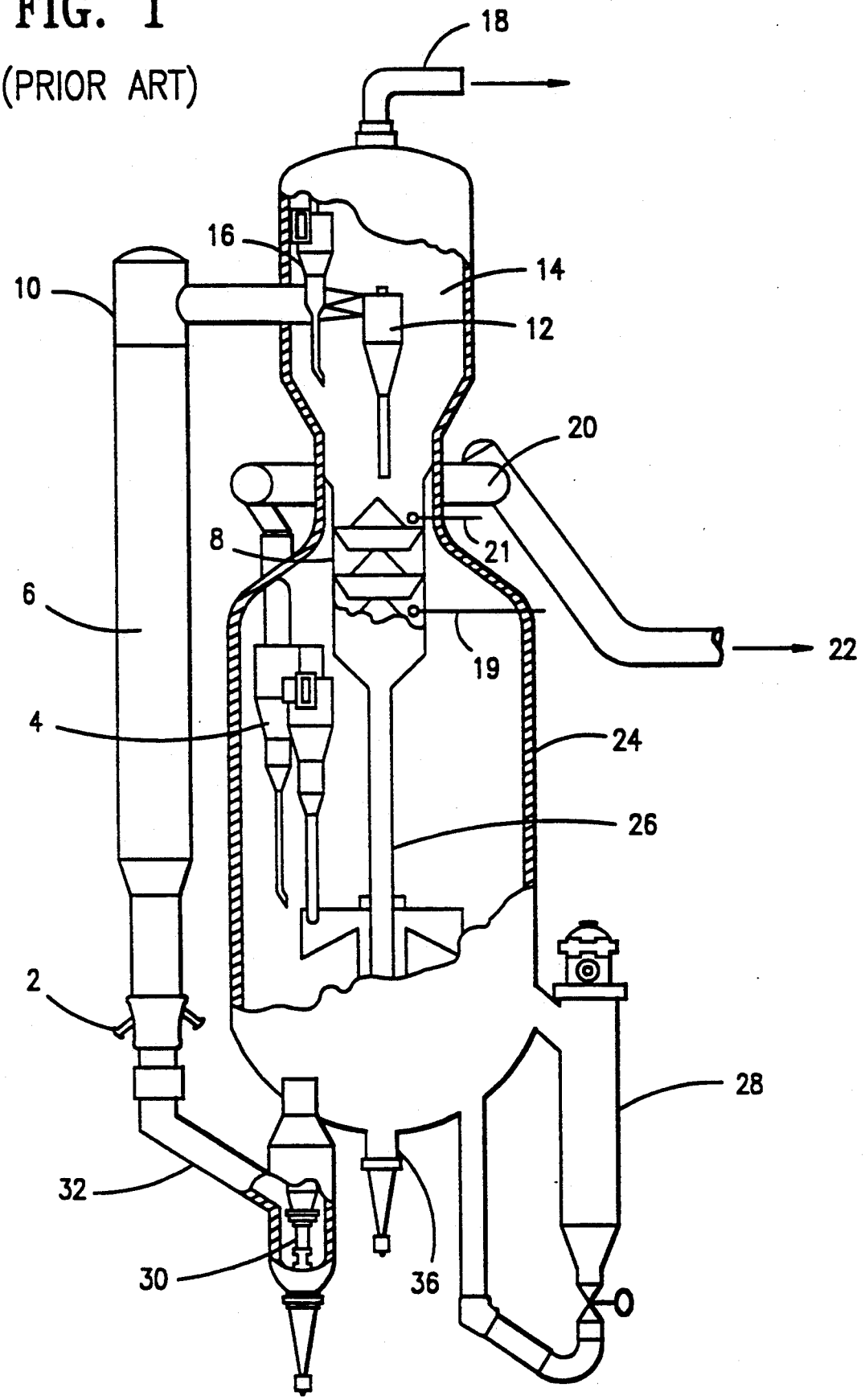
FIG. 1 (PRIOR ART)
FIG. 1 (prior art) is a schematic view of a conventional "Orthoflow" fluidized catalytic cracking unit.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of *Oil & Gas Journal.*

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14 and eventually is removed via upper cyclones 16 and conduit 18 to the fractionator.

Spent catalyst is discharged down from a dipleg of riser cyclones 12 into catalyst stripper 8 where one, or preferably 2 or more, stages of steam stripping occur, with stripping steam admitted by means not shown in the figure. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, is discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
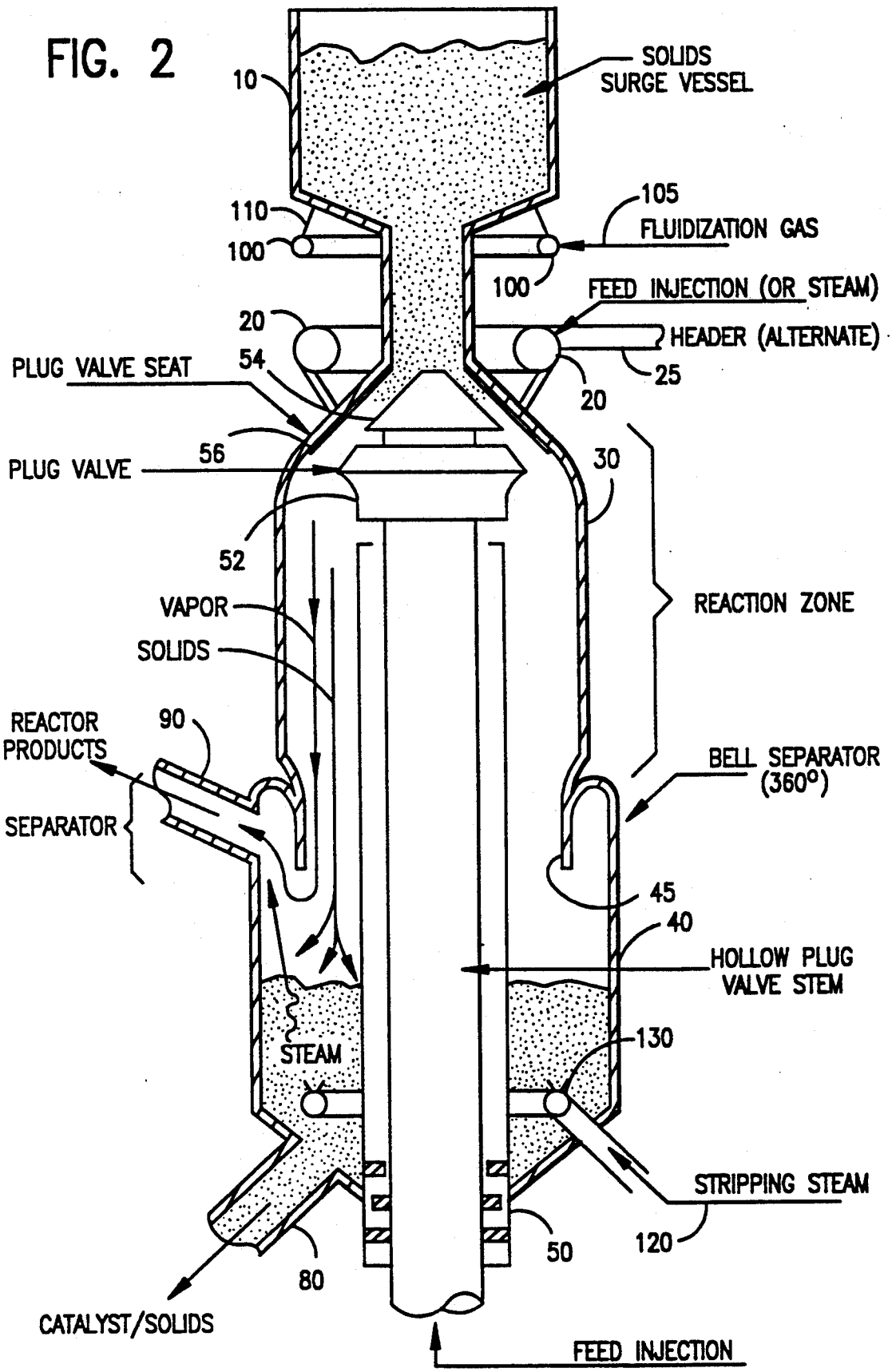
FIG. 2 (invention) is a schematic view of a short contact time cracking reactor and bell separator.

In FIG. 2 (invention) solids surge vessel 210 acts as a reservoir for hot regenerated catalyst, from a catalyst regeneration means, not shown. Fluidizing gas from line 105, usually fluffing air, can be added via air ring 100 and fluidizing gas inlets 110. Surge vessel 210 may also function as a regenerator.

Hot catalyst passes down through the annular region intermediate the plug valve 54 and the plug valve seat 56, both preferably of a refractory material or other abrasion resistant material. Catalyst forms a downflowing annular curtain or sheet about the plug valve seat and plug valve body. Feed is added to the base of the valve body and passes up through a hollow plug valve stem to exit via a plurality of slots or other flow transmission means around the circumference of the seat of the plug valve or both. The slots may also be drilled holes, or a plurality of radially distributed feed nozzles. Alternatively, holes or fogging nozzles, etc. may be within some lower portion of the hollow plug valve stem so that the large flow of heavy feed purges the inner parts and passages of the plug valve assembly and is dispersed in flowing through the radial slit or slot intermediate the ceramic cone and the base of the tube. Although a hollow plug valve stem, as shown, is preferred, it is possible to use a solid valve stem with one or more tubes or pipes transmitting feed to an outlet means beneath the plug valve for discharging feed out into an annular, falling curtain of catalyst.

The large feed stream flow can not only lubricate and purge the plug valve assembly, it can cool it. With heavier feeds, the regenerated catalyst temperature tends to be higher. The mechanical problems of controlling the flow of fluidized solids having a temperature above 1400° F., and sometimes approaching 1500° or even 1600° F., with excursions to the 1700° F.-1800° F. range possible, are formidable. Using a hollow plug stem valve to add the feed keeps the metal parts of the valve relatively cool, and exposes only the conical plug valve to high temperature catalyst. Use of a ceramic material for part 54, and perhaps for part 56, permits extremely high regenerated catalyst temperatures to be used, while keeping the valve body at a temperature approaching that of the feed.

The incoming feed, which usually will be mixed with 1 to 5 wt % atomization steam, will usually suffice to purge the interior spaces of the valve, or conventional amounts of purge gas may be added to the valve mechanism to keep it purged of catalyst and prevent formation of dead spaces which could form coke.

It may be preferred to add some of the feed via a plurality of radially distributed feed nozzles distributing feed through ring distributor 220 to feed nozzles. Steam may also be added in this way.

The mixture of catalyst and hydrocarbon feed passes down through vessel 230, which has a much larger diameter than the plug valve. The increased diameter, and increased cross sectional area expand gas flow through the system, but the increased cross sectional area available for flow will be offset to some extent by molar expansion during the cracking reaction.

After a very short hydrocarbon residence time, usually less than a second, the mixture of vapor and solids will enter the bell separator region of vessel 230. Here solids are carried down, by inertia and by gravity, while vapor is forced to make a 180 degree turn up into region 47 of the bell separator. Reactor products are removed via outlet 90. Bell separator preferably encompasses the entire radius of the lower section of vessel 230. Providing lip 45 is long enough, and region 47 is large enough, a majority of the gas flow in the region of the separator will involve a 180 degree flow reversal. A plurality of reactor product outlets 90 may be used to improve flow patterns within the bell separator, i.e., 4 radially distributed outlets will essentially eliminate horizontal flow of gas when it is in contact with spent catalyst.

Spent catalyst collects as a fluidized bed in the lower portion of the bell separator. Stripping steam added via line 120 and steam distributor ring 130 provides the stripping steam needed to remove entrained and adsorbed but displaceable hydrocarbons from catalyst. Stripped catalyst is removed via solids outlet means 80 to a regenerator or decoker, not shown.

DESCRIPTION OF PREFERRED EMBODIMENTS

FCC FEED

Any conventional FCC feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids, and mixtures thereof. The present invention is most useful with feeds having an initial boiling point above about 650° F.

The most uplift in value of the feed will occur when a significant portion of the feed has a boiling point above about 1000 F. or is considered non-distillable, and when one or more heat removal means are provided in the regenerator, as shown in FIG. 1 or in FIG. 3.

FCC CATALYST

Any commercially available FCC catalyst may be used. The catalyst can be 100% amorphous, but preferably includes some zeolite in a porous refractory matrix such as silica-alumina, clay, or the like. The zeolite is preferably 25–80 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high zeolite contents, and use of high silica zeolite containing catalysts, are preferred for use in the present invention. They efficiently crack feed in less than a second and withstand the high temperatures preferred for short contact time cracking, especially when cracking resid feeds.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Additives for removal of SOx are available from several catalyst suppliers, such as Davison's "R" or Katalistiks International, Inc.'s "DeSox." CO combustion additives are available from most FCC catalyst vendors.

The FCC catalyst composition, per se, forms no part of the present invention.

CRACKING REACTOR/STRIPPER/REGENERATOR

The FCC reactor and stripper work together to efficiently contact catalyst and feed, and within a second separate spent catalyst from cracked products and begin stripping.

The reactor/stripper will generally comprise a single generally cylindrical vessel with a reactor section comprising an annular falling curtain of catalyst, formed by catalyst flow through a plug valve. Fresh feed added through the plug valve contacts hot regenerated catalyst, and the resulting mixture falls cocurrently down through an annular reactor defined by the inner walls of the cylindrical reaction zone and the outer walls of the hollow plug valve stem.

The lower part of the reactor, sometimes termed a bell separator, comprises a vertical cylindrical vessel, preferably having a larger cross sectional area than the reaction zone, with a circumferential, downwardly extending lip or periphery creating two annular regions within a separation zone with an inner annular zone having as its inner limit the valve stem and as its outer limit the downardly extending lip and an outlet annular zone having as its inner limit the downwardly extending lip and as its outer limit the wall of the separation zone.

Contiguous with and beneath the bell separator is a catalyst stripping zone, having in lower portions thereof a means for admitting and distributing stripping gas, such as stripping steam, and an outlet for stripped catalyst. The stripping zone may contain chevron packing or other baffles to improve contact of stripping steam with spent catalyst. Preferably relatively large amounts of stripping steam are added, and/or the diameter is such as to produce relatively high superficial vapor velocities. Large amounts of stripping steam, e.g. more than 1%, preferably more than 2%, and most preferably more than 3%, will quench to some extent the high temperature cracked products, minimize thermal cracking, and rapidly sweep cracked products from the reactor and vigorously strip spent catalyst.

The stripper geometry, and the amount of stripping steam or other stripping stream added, should be sufficient to significantly expand the bed of catalyst in the stripper. In most units, such as those using conventional FCC catalyst, with an average particle size within the range of 50–90 microns, the superficial vapor velocity will be well above 1 foot per second. Stripper vapor velocity should not be so high as to entrain undue amouns of catalyst into the dilute phase region of the stripper. Entrainment or displacement of spent catalyst into the dilute phase region is not especially beneficial, but is largely unavoidable. Creation of a significantly expanded dense bed of gradually increasing density in the base of the stripper can be a critical factor in reducing catalyst attrition. This expanded region provides the fast falling solids with a deceleration zone. Some deceleration of catalyst occurs merely because of flow reversal (cracked products flowing sideways to the the annular cracked product outlet) and because of the upflow of stripping steam. Further gradual deceleration of the catalyst, a "soft landing" occurs when falling catalyst lands in a vigorously fluidized bed rather than a much denser bubbling dense bed. A soft landing, rather than hitting a concrete or metal plate as in some prior art designs, minimizes catalyst attrition.

Additional conventional catalyst/cracked product separation means can be provided downstream of primary products separator 90, e.g., cyclone separators.

The regenerator vessel can be conventional. Usually catalyst from the stripper will flow down into a conventional regenerator (whether a swirl type, cross-flow, high efficiency) operating alongside of the reactor and stripper. A lift means will usually be provided to transport catalyst from the regenerator up to the solids surge vessel, or the solids surge vessel may be the regenerator, or one stage of regenerator.

Conditions in the regenerator can be conventional, but usually will be somewhat hotter than most FCC regenerators. Regenerator temperature will usually range from 1000° to 1800° F., preferably from 1200°–1600° F., with most units operating with temperatures from 1250 to 1500.

FCC REACTOR CONDITIONS

Conventional short residence time cracking conditions may be used, but are not preferred. Typical riser cracking reaction conditions include catalyst/oil ratios of 0.5:1 to 15:1 and preferably 3:1 to 8:1. In my process, cat:oil ratios will generally be much higher, and residence times of both catalyst and oil much lower than in conventional riser cracking units. Thus I prefer to operate with a reactor vapor residence time of 0.01 to 1.0 seconds, and preferably 0.05 to 0.9 seconds, and most preferably about 0.1 to 0.8 seconds. The residence time of catalyst and hydrocarbon will be about the same, because downflow operation largely eliminates slip. The catalyst may have a slightly shorter residence time than the oil, because gravity will accelerate it some, but this is offset by molar expansion, and generally high vapor velocities where oil meets catalyst and accelerates catalyst up to vapor velocity.

The reactor initial mix temperature, where falling catalyst contacts feed, will usually be within the range of 850° to 1650° F., preferably 1000° to 1400° F., and most preferably 1050° to 1300° F. This assumes that catalyst and hydrocarbon are well mixed, which will never be achieved instantly in a commercial unit, but can be calculated with accuracy. The temperature at the base of the reactor (corresponds to riser top temperature in a riser cracking unit) may range from about 800° to about 1400° F., preferably 850° to 1250° F. and most preferably from 900° to 1050° F.

CO COMBUSTION PROMOTER

Use of a CO combustion promoter in the regenerator or combustion zone is not essential for the practice of the present invention but may be used if desired. These materials are well-known.

U.S. Pat. No. 4,072,600 and U.S. Pat. No. 4,235,754, incorporated by reference, disclose operation of an FCC regenerator with minute quantities of a CO combustion promoter. From 0.01 to 100 ppm Pt metal or enough other metal to give the same CO oxidation may be used with good results. Very good results are obtained with as little as 0.1 to 10 wt. ppm platinum present on the catalyst in the unit.

ILLUSTRATIVE EMBODIMENTS

The following illustrative embodiments do not represent actual tests in commercial size units, rather they represent computer and hand calculated yield estimates. The computer simulations and hand calculations are believed highly reliable predictors of what would occur in commercial practice.

The Base Case (prior art) is a yield estimate for a conventional FCC riser reactor cracking a fairly clean feed.

Case 1 (invention) is a yield estimate based on the same feed, using the same catalyst in a short residence time cracking in the process and apparatus of the present invention.

Case 2 (invention) is a somewhat optimized case. The feed is the same, and the conditions are very similar to those used in Case 1. Case 2 uses a more active catalyst, having an activity 10% higher than that of the base case. Higher catalyst activity is easily achieved in practice by resorting to higher makeup rates, or using a catalyst of higher zeolite content or both.

The results are presented below in a side by side table:

SHORT CONTACT TIME YIELD ESTIMATES

| | Base | Case 1 | Case 2 |
|---|---|---|---|
| Feed Properties | | | |
| API | — | 24.0 | — |
| Con Carbon | — | 0.42 | — |
| UOPk | — | 11.5 | — |
| RI @ 70° C. | — | 1.490 | — |
| CAT Properties | | | |
| Activity | Base | Base | 1.1 × Base |
| Surface Area $M^2/9$ | 185 | 185 | 185 |
| Density g/cc | 1.44 | 1.44 | 1.44 |
| Ni EQ, ppm | 3000 | 3000 | 3000 |
| Operating Conditions | | | |
| Feed Rate | — | Base | — |
| Feed Temp, °F. | — | 503 | — |
| Reactor Temp, °F.* | — | 970 | — |
| Mix Zone Temp, °F.** | 996 | 992 | 991 |
| C/O Ratio | 9.7 | 14.2 | 14.0 |
| Vapor Res Time, Sec | 3.04 | 0.12 | 0.11 |
| Cat. Res Time, Sec | 3.65 | 0.12 | 0.11 |
| Yields | | | |
| Dry Gas wt % | 4.7 | 4.0 | 4.8 |
| $C_2$ = | 1.4 | 1.2 | 1.5 |
| $C_3$'s | 8.9 | 7.2 | 9.1 |
| $C_y$'s | 18.0 | 14.6 | 18.4 |
| Gasoline | 45.9 | 48.4 | 45.9 |
| LCO | 12.1 | 15.2 | 12.2 |
| MCB | 4.5 | 5.9 | 4.5 |

-continued

| SHORT CONTACT TIME YIELD ESTIMATES | | | |
|---|---|---|---|
| | Base | Case 1 | Case 2 |
| Coke | 4.5 | 3.5 | 3.6 |
| | 100.0 | 100.0 | 100.0 |

*Reactor temp in Base Case refers to conventional riser reactor configuration and the temp. is the temp. of riser outlet. For this invention the reactor temp. refers to the catalyst/oil vapor mixture just as it exits the bell separator (see attached figure) and prior to mixing with the steam from the stripper.

**Mix Zone Temperature refers to the mixture at the base of the riser just off the feed nozzles assuming per feet mixing. For this invention it refers to the mixture temperature in the area of the plug valve and seat.

These yield estimates show that significant improvements can be made even in a mature process like fluidized catalytic cracking.

The use of the process and apparatus of the claimed invention will significantly reduce coke and dry gas yields, while increasing gasoline yields as compared to the prior art riser cracking process. Case 1 shows these benefits, even when using a catalyst which is optimized for conventional riser cracking. The only drawback is some decrease in yields of valuable light olefins, and an increase in relatively heavy liquid fractions, LCO and MCB.

Case 2 shows that yields of valuable light products can be increased without increasing production of LCO and MCB by using a higher activity catalyst. Case 2 also reduces coke make, and leaves dry gas production almost unchanged, as compared to the Base Case.

The process and apparatus of the present invention gives a refiner unusual flexibility in the FCC process. The process allows the full potential of higher activity catalysts to be used, in part because the catalyst is used for such short time. In the conventional FCC process the catalyst activity plummets within ½ or 1 second within the FCC riser due to coke build up on catalyst, so much of the feed conversion occurs due to thermal cracking or to cracking over catalyst with a much reduced activity as compared to freshly regenerated catalyst.

In contrast, the process of the present invention promotes catalytic cracking, and almost eliminates thermal cracking by severely limiting residence time. The residence time of catalyst in the reactor is reduced by more than an order of magnitude as compared to the prior art riser cracking process, largely eliminating "low activity" catalytic cracking which characterized the prior art process.

As an alternative, even higher reactor temperatures could be used to achieve higher conversions with catalyst having the same activity as the base case, or some combination of higher temperatures and higher activity catalyst could be used.

The process and apparatus of the present invention provide a reliable and efficient way to achieve residence time cracking. Although localized high vapor and catalyst velocities will be used around the plug valve, the expanded bed of catalyst present in the stripper will provide a way for high velocity catalyst streams to slow down without eroding the process equipment or attriting the catalyst. The high vapor and catalyst velocities also make the bell separator work efficiently, in effect extracting some useful work from the kinetic energy in these streams.

I claim:

1. A process for the fluidized catalytic cracking of a heavy feed to lighter products comprising:

forming a falling, annular curtain of regenerated FCC catalyst by discharging said FCC catalyst down through a vertical, cone shaped plug valve having a base attached to a vertical stem which controls the flow of said catalyst;

contacting said falling annular curtain of catalyst with a heavy feed by discharging from at least one of the base of the cone shaped plug valve or the stem of said valve said hydrocarbon feed in radial in to out flow, forming a downflowing mixture of catalyst and feed and vaporizing at least a majority by weight of said feed;

cracking said feed in a vertical, cylindrical reactor vessel by passing said downflowing mixture as an annulus defined by the walls of said reactor vessel and the stem of said plug valve at catalytic cracking conditions including a superficial vapor velocity of at least 20 feed per second and a total catalyst and hydrocarbon vapor contact time of 0.01 to 1.0 seconds to produce cracked vapor products and spent catalyst;

separating cracked products from spent products in an inertial separation means to produce a cracked product vapor phase and a spent catalyst phase, and wherein said inertial separation means is a cylindrical shaped bell separator contiguous with and beneath said cylindrical reactor, said bell separator comprising:

an annular inlet in an upper portion of said bell separator having a diameter, and defined by the wall of said valve stem and a circumferential lip;

an annular flow expansion and vapor flow reversal section downstream of said annular inlet, defined by the wall of said valve stem and an outer wall of the cylindrical bell shaped separator, said outer wall having a diameter greater than the diameter of the reaction zone or of the diameter of the annular inlet, and having:

in a lower portion thereof an inlet for stripping gas and an outlet for stripped catalyst; and in an upper portion thereof at least one vapor outlet connective with and passing through said outer wall of said cylindrical separator vessel and connective with an annular, circumferential vapor removal means extending radially about at least 90% of the circumference of said separator, defined by said circumferential lip and said wall of said separator;

recovering cracked products from said cracked product vapor phase as products of the process;

stripping said spent catalyst phase in a catalyst stripping means at catalyst stripping conditions to produce stripped catalyst;

regenerating in a catalyst regeneration means operating at catalyst regeneration conditions said spent catalyst to produce regenerated catalyst; and charging regenerated catalyst to the top of said plug valve.

2. The process of claim 1 wherein the superficial vapor velocity in the reactor vessel is 20 to 200 fps.

3. The process of claim 1 wherein said annular inlet of said bell separator has a reduced cross sectional area as compared to a cross sectional area of said reactor, and the superficial vapor velocity within said annular inlet is from 25 to 250 feet per second.

4. The process of claim 3 wherein the superficial vapor velocity within said annular inlet is from 50 to 100 feet per second.

5. The process of claim 1 wherein said superficial vapor velocity in said stripper expansion section downstream of said annular inlet is from 20 to 200 feet per second and is reduced as compared to said superficial velocity in said annular inlet.

6. The process of claim 5 wherein superficial vapor velocity in said stripper expansion section is from 40 to 80 feet per second.

7. The process of claim 1 wherein the cat:oil ratio in said cracking reactor is at least 10:1.

8. The process of claim 1 wherein the cat:oil ratio in said cracking reactor is at least 15:1, and the residence time of both catalyst and hydrocarbon in said cracking reactor is less than 0.15 seconds.

9. The process of claim 1 wherein said inertial separator comprises a cyclone separator.

10. A process for the fluidized catalytic cracking of a heavy feed to lighter products comprising:

forming a falling, annular curtain of regenerated FCC catalyst by discharging said FCC catalyst down through a vertical, cone shaped plug valve having a base attached to a vertical stem which controls the flow of said catalyst;

contacting said falling annular curtain of catalyst with a heavy feed by discharging from at least one of the base of the cone shaped plug valve or the stem of said valve said hydrocarbon feed in radial in to out flow, forming a downflowing mixture of catalyst and feed and vaporizing at least a majority by weight of said feed;

cracking said feed in a vertical, cylindrical reactor vessel having a vertical axis by passing said downflowing mixture as an annulus defined by the walls of said reactor vessel and the stem of said plug valve at catalytic cracking conditions including a superficial vapor velocity of 20 to 200 feet per second and a total catalyst and hydrocarbon vapor contact time of 0.01 to 1.0 seconds to produce cracked vapor products and spent catalyst;

separating cracked products from spent catalyst in a vertical, cylindrical, bell shaped, inertial separation means having a vertical axis axially aligned with said vertical axis of said cracking reactor and contiguous with and beneath said cracking reactor, to produce a cracked product vapor phase and a spent catalyst phase, said inertial separator comprising:

an annular inlet for catalyst and cracked products in an upper portion of said bell separator having a diameter, and defined by the wall of said valve stem and a circumferential lip;

an annular flow expansion and vapor flow reversal section downstream of said annular inlet, defined by the wall of said valve stem and an outer wall of the cylindrical bell shaped separator, said outer wall having a diameter greater than the diameter of the reactor or of the diameter of the annular inlet, and having:

an inlet for stripping gas in a lower portion thereof; and an outlet for stripped catalyst in a lower portion thereof; and at least one vapor outlet in an upper portion thereof connective with and passing through said outer wall of said cylindrical separator vessel and connective with an annular, circumferential vapor removal means extending 360 degrees about the wall of said separator, defined by said circumferential lip and said wall of said separator;

regenerating in a catalyst regeneration means operating at catalyst regeneration conditions said spent catalyst to produce regenerated catalyst; and charging regenerated catalyst to the top of said plug valve.

11. The process of claim 10 wherein said annular inlet of said bell separator has a reduced cross sectional area as compared to a cross sectional area of said reactor, and the superficial vapor velocity within said annular inlet is from 25 to 250 feet per second.

12. The process of claim 11 wherein the superficial vapor velocity within said annular inlet is from 50 to 100 feet per second.

13. The process of claim 10 wherein said superficial vapor velocity in said expansion section downstream of said annular inlet is from 20 to 200 feet per second and is reduced as compared to said superficial velocity in said annular inlet.

14. The process of claim 13 wherein the superficial vapor velocity in said expansion section is from 40 to 80 feet per second.

15. The process of claim 10 the cat:oil ratio in said cracking reactor is at least 15:1, and the residence time of both catalyst and hydrocarbon in said cracking reactor is less than 0.15 seconds.

* * * * *